US005458533A

United States Patent [19]

Barth et al.

[11] Patent Number: 5,458,533

[45] Date of Patent: Oct. 17, 1995

[54] ECCENTRIC DISK SANDER

[75] Inventors: Walter Barth, Leinfelden-Echterdingen; Michael Knuth, Stuttgart, both of Germany

[73] Assignee: Robert Bosch GmbH, Stuttgart, Germany

[21] Appl. No.: 232,212

[22] PCT Filed: Oct. 4, 1993

[86] PCT No.: PCT/DE93/00933

§ 371 Date: May 3, 1994

§ 102(e) Date: May 3, 1994

[87] PCT Pub. No.: WO94/07654

PCT Pub. Date: Apr. 14, 1994

[30] Foreign Application Priority Data

Oct. 7, 1992 [DE] Germany ..... 42 33 728.3

[51] Int. Cl.[6] ..... B24B 23/00

[52] U.S. Cl. ..... 451/357; 451/344

[58] Field of Search ..... 451/357, 342, 451/344, 350, 353, 354, 359, 271, 294

[56] References Cited

U.S. PATENT DOCUMENTS

| | | | |
|---|---|---|---|
| 4,322,921 | 4/1982 | Maier | 451/357 |
| 4,610,111 | 9/1986 | Cox | 451/357 |
| 4,727,682 | 3/1988 | Stabler et al. . | |
| 5,251,406 | 10/1993 | Kirn | 451/344 |
| 5,261,190 | 11/1993 | Berger et al. | 451/357 |

FOREIGN PATENT DOCUMENTS

| | | | |
|---|---|---|---|
| 0406247 | 2/1992 | European Pat. Off. . | |
| 1900889 | 1/1969 | Germany | 451/357 |

*Primary Examiner*—Bruce M. Kisliuk
*Assistant Examiner*—Derris H. Banks
*Attorney, Agent, or Firm*—Michael J. Striker

[57] ABSTRACT

For an eccentric disk sander (1, 101, 161) with a housing, in particular a multi-part housing (3, 103, 9, 109, 162, 165), in which a motor with a motor shaft (16, 116, 170) moves a sanding disk (13, 113, 167) via an eccentric (19, 119, 173), in which arrangement the eccentric (19, 119, 173) carries the sanding disk (13, 113, 167) gyrating about the rotational axis (18, 118, 172) with the eccentricity "e", and simultaneously rotating about the spindle (26, 126, 177), the task of providing a compact, robust, and convenient unit is solved by the hollow shaft (19, 119, 173), open at both ends, being designed with an eccentric hole (25, 125, 176), beyond which an eccentric shaft (27, 127, 178) which carries the sanding disk (13, 113, 167) protrudes from at least one end.

11 Claims, 2 Drawing Sheets

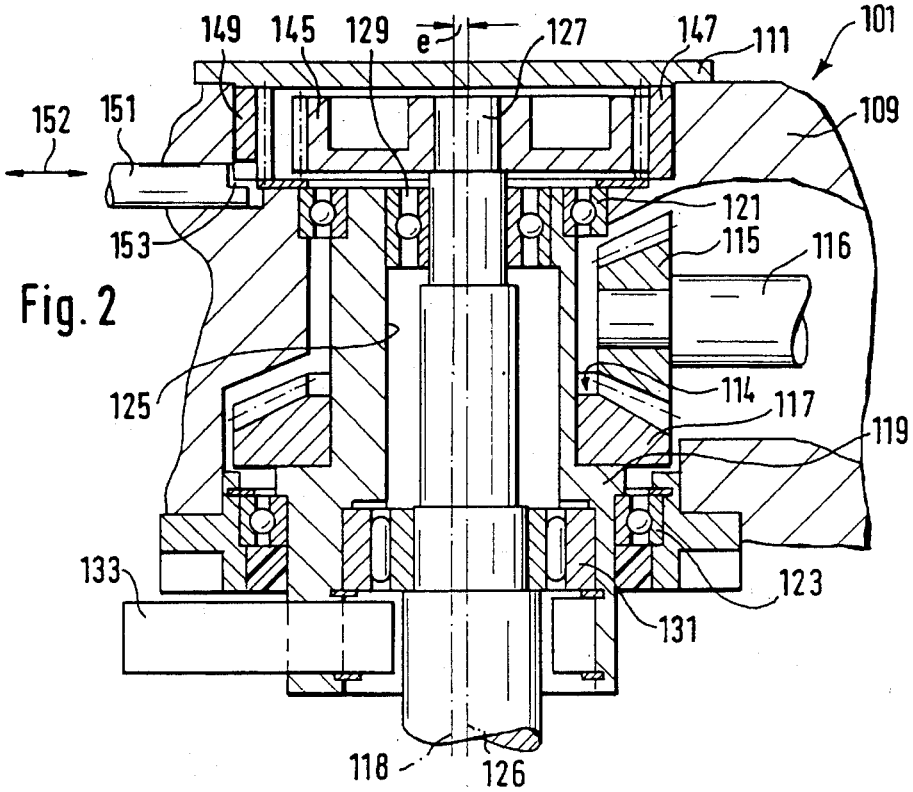
Fig. 2
Fig. 3
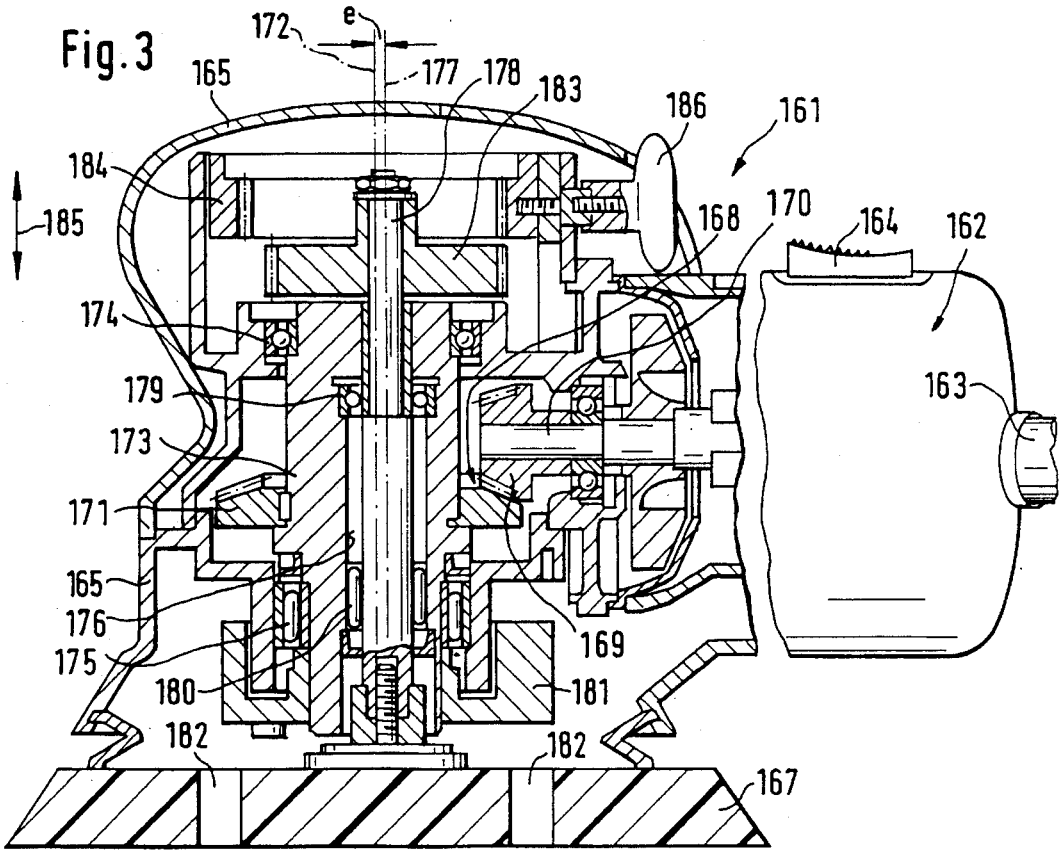

ECCENTRIC DISK SANDER

PRIOR ART

The invention is based on an eccentric disk sander of the generic type of claim 1.

An eccentric disk sander corresponding to the generic type is known from the EP 406 247 (U.S. Ser. No. 566 378), the eccentric disk of which is driven by a motor. Via an angle gear drive, the motor rotation is converted into the operating motion, which is of a rotational and a gyrating movement of the sanding disk. The angle drive take-off shaft is fixed at its free end to an eccentric. This eccentric, which is rotatably supported, carries a spigot on which the sanding disk is fixed relative to the take-off shaft, with an eccentricity "e". The sanding disk gyrates with the eccentricity "e" about the take-off shaft axis, at the same time rotating, due to the bearing friction, and performing the operating movement.

The bearings between the eccentric and the spigot are subjected to irregular loads. This causes heat development and wear. Moreover, in the known eccentric disk sanders, which usually stem from angle grinder designs, the separation between the sanding disk and the angular drive is large. This generates particularly high bearing forces. In addition, the sanding disk vibrations place a high physical Stress on the operator.

Advantages of the Invention

In contrast, the eccentric disk sander in accordance with the invention with the characterising features of claim 1 has the advantage that it is of a compact construction, has minor bearing wear, reduced vibration, lower manufacturing costs and better handling.

Due to the fact that instead of a spigot which carries the sanding disk, a long eccentric shaft is rotatably supported, and the eccentric is designed as a hollow shaft open at both ends, the bearing separation for the eccentric shaft can be very large, with the dimensions of the angular drive housing being compact. The bearing forces can be better calculated and controlled. The running of the eccentric shaft becomes smoother, and the bearing wear will lessen in spite of smaller bearings.

Further advantageous refinements of the invention are made possible by the claims following claim 1. It is regarded as particularly advantageous that the sanding disk movement can be influenced from that end of the eccentric shaft which faces away from the disk.

Drawing

Embodiment examples of the invention are more closely explained in the description which follows and in the attached drawings.

FIG. 1 shows an eccentric disk sander in accordance with the invention, FIG. 2 shows an enlarged section from FIG. 1, showing a view of the arrangement of the eccentric shaft support, with slightly varying function, and FIG. 3 shows a further embodiment example of an eccentric disk sander in accordance with the invention.

DESCRIPTION OF THE EMBODIMENT EXAMPLE

Figure 1:
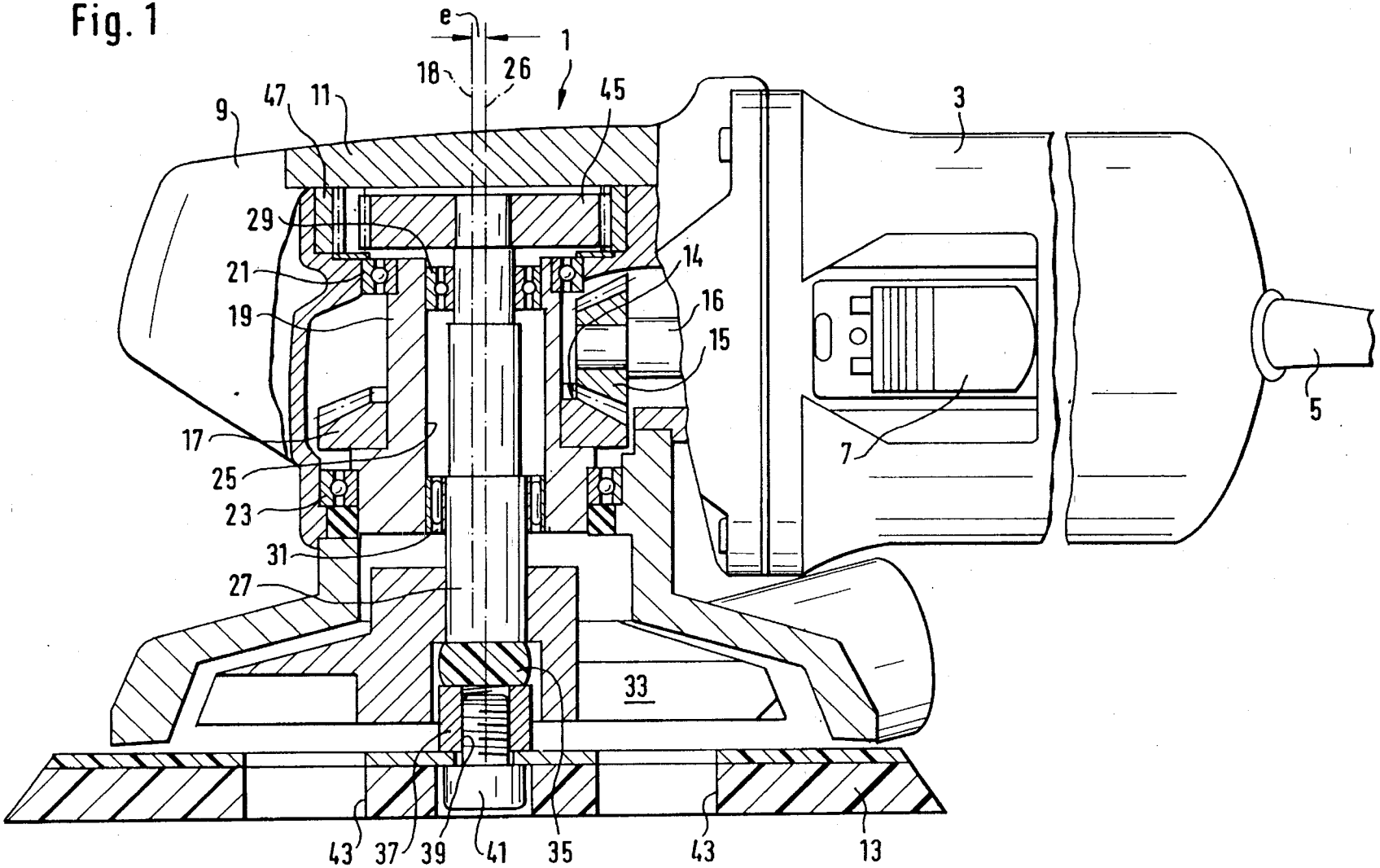

The eccentric disk sander 1 shown in FIG. 1, has a motor housing 3 on which an electric connection cable 5 and an ON/OFF switch 7 are arranged. The motor housing 3 has a housing 9 flange mounted to it which is designed as an angle drive housing and which carries an upper housing cover 11 and an angle drive 14 which is operationally connected to a sanding disk 13. The angle drive 14 consists of a small bevel wheel 15 which is located on a motor shaft 16 and which transmits the motor speed to a large bevel wheel 17. The bevel wheel 17 concentrically and fixed, embraces an eccentric which is designed as a hollow shaft 19, revolving about a rotational axis 18. The hollow shaft 19 is supported in the housing 9 in bearings 21, 23 which are located in regions both close to and remote from the sanding disk, this hollow shaft at the same time forms the take-off shaft of the angle drive 14. The hollow shaft has a bore 25 which is eccentric in relation to the rotational axis 18, with a spindle 26. The spindle 26 extends at a separation from the rotational axis 18, parallel to it, with the eccentricity "e". Within the eccentric bore 25, an eccentric shaft 27 is guided concentrically with the spindle 26, in an upper ball race 29 and a lower needle bearing 31.

A fan 33 for dust extraction, serving also as a balancing mass, is fixed at the lower end region of the eccentric shaft 27. The free end of the eccentric shaft 27 carries a flexible coupling 35, for example an injection-moulded plastic part. This is followed by a fixed nut 37, which has a threaded hole 39 on which the sanding disk 13 is fixed by means of a bolt 41. The fixed flexible coupling 35, with bending flexibility, transmits the force from the eccentric shaft 27 to the sanding disk 13. The sanding disk 13 is provided with recesses 43 which are evenly distributed across its surface and through which the sanding dust can be extracted from the workpiece. At the upper end region of the eccentric shaft 27, is a fixed spur gear 45, which meshes with an annular gear 47 which is fixed to the housing. When the hollow shaft 19 rotates, the spur gear 45 rotates together with the eccentric shaft 27. Due to the rolling contact with the annular gear 47, the spur gear 45 rotates about the spindle 26, carrying with it the eccentric shaft 27 and the sanding disk 13.

When the motor, which is not shown, is switched on by means of the ON/OFF switch 7, the motor shaft 16 rotates, carrying with it the bevel wheels 15, 17. The bevel wheel 17 rotates about the rotational axis 18, together with the hollow shaft 19. In its eccentric bore 25, the eccentric 19 carries with it the eccentric shaft 27. The eccentric shaft 27 rotates about the rotational axis 18 with the eccentricity "e". In this action, due to the friction in the bearings 29, 31, the hollow shaft 19 seeks to accelerate the eccentric shaft 27, to its own high speed. This is what is meant by 'revving up'. This is prevented by the mesh of the spur gear 45 with the annular gear 47.

The sanding disk 13 follows the movement of the eccentric shaft 27, during which action it is supported via the flexible coupling 35 on the eccentric shaft 27. During sanding operations, the sanding disk 13 can readily adapt to the workpiece surfaces, or it can without twisting, follow a horizontal swing of the eccentric shaft axis relative to the normal in relation to the workpiece, during the handling of the eccentric disc sander. This allows workpieces to be worked carefully, without any jerking movement.

The arrangement of the roller or needle bearing 31 in the vicinity of the sanding disk 13, and the arrangement of the ball race 29, away from the sanding disk 13, between the eccentric shaft 27 and the hollow shaft 19 improves the efficiency of the motion transmission, and markedly increases the life of the eccentric disk sander 1 in relation to prior art, since the radial and axial bearing forces are absorbed separately and can thus be better controlled.

The enlargement of the front region of the eccentric disk sander 101, shown in FIG. 2, from FIG. 1, slightly modified, makes clear the arrangement of the housing 109 with the upper housing cover 111, which is designed as an angle drive housing, and also the angle drive 114 which is operationally connected to the sanding disk (not shown), with the small bevel wheel 115, the motor shaft 116, and the large bevel wheel 117, the hollow shaft 119 which is embraced concentrically and in a fixed manner by the bevel wheel 117, and the bearings 121, 123.

The drawing shows particularly clearly the bore 125, which is eccentric in relation to the rotational axle 118, with an axle 126, within which the eccentric shaft 127 is guided in the upper ball race 129 and the lower needle bearing 131, concentric in relation to the axle 126.

The lower end region of the eccentric shaft 127 is shown with a balancing mass 133, which is fixed, without a fan and without a sanding disk. The upper end region is shown with the spur gear 145 which meshes with the annular gear 147.

Differing from the embodiment example of FIG. 1, FIG. 2 shows the hollow shaft 119 extended so as to enable it to support the balancing mass 133 at the lower, free, end. Moreover, the annular gear 147 is arranged to be arrestable by a locking bar 151, which is rotatable within a sliding bearing 149 on the angular drive housing 109.

When the annular gear 147 is arrested, the progression of movement of the eccentric shaft 127 corresponds to the description relating to FIG. 1. When the locking bar 151 is disengaged from the detent recess 153 in the annular gear 147, this gear can rotate and prevent the roll-off of the spur gear 145 so that the latter cannot rotate about its own axle 126, but can rotate only about the axis 118. This movement is transmitted to the sanding disk via the eccentric shaft 127 and results in a comparatively lower stock removal than with a simultaneously rotating and gyrating sanding disk. In this position of the locking bar 151, the eccentric shaft 127 is again prevented from following the bearing friction in the bearings 131,129 and 'revving up' to the speed of the eccentric shaft carrier, thereby causing damage to the workpiece surfaces by the accelerating sanding disk: due to the friction between the annular gear 147 and the housing 109, a brake to the 'revving-up' has been provided for the fine treatment stage.

FIG. 3 shows a further embodiment example of an eccentric disk sander 161 which is in principle like those shown in FIGS. 1 and 2. This example has a motor housing 162, on which an electrical connection cable 163 and an ON/OFF switch 164 are arranged. A housing 165 designed as an angle drive housing is flange mounted on the motor housing 162, and it contains an angle drive 168 which is operationally connected to a sanding disk 167.

The angle drive 168 consists of a small bevel wheel 169 which is located on a motor shaft 170 and transmits the motor speed to a large bevel wheel 171. The bevel wheel 171 embraces an eccentric concentrically and fixed, this eccentric rotates about a rotational axis 172 and is designed as a hollow shaft 173. The hollow shaft 173 is supported in a housing 165 in a roller or needle bearing 175 which is close to the sanding disk, and in a ball race 174 which is remote from the sanding disk. The hollow shaft 173 has a bore 176, which is eccentric in relation to the rotational axis 172, with an axle 177. The axle 177 extends at a separation from the rotational axis 172, parallel with it, with the eccentricity "e". Within the eccentric bore 176, an eccentric shaft 178 is guided concentrically with the axle 177, in an upper ball race 179 and a lower needle bearing 180.

A balancing mass 181 is fixed at the lower end region of the hollow shaft 173. The free end of the eccentric shaft 178 carries the sanding disk 167 which is provided with recesses 182 which are evenly distributed across its surface and through which the sanding dust can be extracted.

At the upper end region of the eccentric shaft 178, a spur gear 183 is fixed, which meshes with an annular gear 184 which is fixed to the housing. The annular gear 184 is supported so as to be axially movable in the housing 165 and can be engaged by means of a selector knob 186 with the spur gear 183 or disengaged from it, the means which are not shown in detail.

When the motor, which is not shown, is switched on by means of the ON/OFF switch 164, the motor shaft 170 rotates and carries with it the bevel wheels 169,171. The bevel wheel 171 rotates together with the hollow shaft 173 about the rotational axis 172. In its eccentric bore 176, the hollow shaft 173 takes with it the eccentric shaft 178. The eccentric shaft 178 rotates about the rotational axis 172 with the eccentricity "e", with the sanding disk 167 following this movement.

Since the spur gear 183 is not engaged with the annular gear 184, the eccentric shaft 178 is moved along only by the friction in the bearings 179, 180 which the sanding disk 167 follows. When the sanding disk 167 is pressed against a workpiece surface, the disk will rotate only at a slow speed, gyration, so to speak, at standstill. During this type of movement, the sanding action is at its minimum, so that the operating setting "fine sanding" is set.

By moving the annular gear 184 axially in the directions of the arrow 185, the operational connection to the spur gear 183 can be made or interrupted by turning the selector knob 186. This provides a selecting facility for two machining stages, fine and coarse sanding.

The arrangement of the roller or needle bearings 175, 180, i.e. of the bearings which absorb radial forces, in the vicinity of the sanding disk 167, and the arrangement of the ball races 174, 179, i.e. of the bearings which absorb axial forces, remote from the sanding disk 167 between the eccentric shaft 178 and the hollow shaft 173 and also between the eccentric 173 and the housing 165 again improves the efficiency of the movement transmission and markedly increases the life of the eccentric disk sander 101 compared to the known eccentric disk sander.

In an embodiment example of the invention which is not shown, a flexible coupling which can be bridged, is arranged between the sanding disk and the eccentric shaft so that it is possible to work with conventional eccentric disk sanders, if required.

The adjusting means for changing the machining stage or the gear position, which are not shown, are bolts, according to the DE-OS 36 02 571, which are connected to the annular gear which is itself fixed to the housing, these bolts are guided in oblique guides or oblique slots in the housing. When the bolts are moved in the slots, the annular gear is moved axially. The bolt carries at least one clamping or detent device, the tightening of which allows the adjusting means to be fixed.

We claim:

1. An eccentric disk sander, comprising a housing accommodating said motor with said motor shaft and formed as a multi-part housing; a sanding disk; a spindle; a motor with a motor shaft; an eccentric via which said motor shaft moves said sanding disk with said eccentric taking with it said sanding disk gyrating with an eccentricity about a rotational axis and simultaneously rotating about said spindle which is eccentric with said eccentricity in relation to said rotational axis, said eccentric being formed as a hollow shaft which is open at its both ends and having an eccentric hole; and an eccentric shaft which carries said sanding disk and protruding beyond said eccentric hole at least at one of said ends; at least two bearings which hold said eccentric shaft in said hollow shaft so that said eccentric shaft is rotatable and axially immovable, said bearings including a roller needle bearing arranged near said sanding disk between said hollow shaft and said eccentric shaft for absorption of radial forces, and a ball race arranged remote from said sanding disk for absorption of axial forces; and a bevel gear fixed on said hollow shaft.

2. An eccentric disk sander as defined in claim 1; and further comprising a spur gear arranged on one end of said eccentric shaft which is remote from said sanding disk and rolling off on a fixable mating wheel which is arranged on said housing and formed as an annular gear.

3. An eccentric disk sander as defined in claim 2; and further comprising adjusting means arranged so that said annular gear is axially movable via adjusting means into an engaging position with said spur gear and disengaging from said spur gear.

4. An eccentric disk sander as defined in claim 2, wherein said spur gear is formed as a balancing mass.

5. An eccentric disk sander as defined in claim 2; and further comprising arresting means formed so that said annular gear can be hindered in its rotational movement by said arresting means.

6. An eccentric disk sander as defined in claim 1; and further comprising a flexible coupling arranged between said eccentric shaft and said sanding disk.

7. An eccentric disk sander, comprising a sanding disk; a spindle; a motor with a motor shaft; an eccentric via which said motor shaft moves said sanding disk with said eccentric taking with it said sanding disk gyrating with an eccentricity about a rotational axis and simultaneously rotating about said spindle which is eccentric with said eccentricity in relation to said rotational axis, said eccentric being formed as a hollow shaft which is open at its both ends and having an eccentric hole; an eccentric shaft which carries said sanding disk and protruding beyond said eccentric hole at least at one of said ends; a housing accommodating said motor with said motor shaft; a spur gear arranged on one end of said eccentric shaft which is remote from said sanding disk and rolling off on a fixable mating wheel which is arranged on said housing and formed as an annular gear; and a friction bearing arranged so that said annular gear is rotatable on said housing with adjustable friction within said friction bearing.

8. An eccentric disk sander, comprising a sanding disk; a spindle; a motor with a motor shaft; an eccentric via which said motor shaft moves said sanding disk with said eccentric taking with it said sanding disk gyrating with an eccentricity about a rotational axis and simultaneously rotating about said spindle which is eccentric with said eccentricity in relation to said rotational axis, said eccentric being formed as a hollow shaft which is open at its both ends and having an eccentric hole; an eccentric shaft which carries said sanding disk and protruding beyond said eccentric hole at least at one of said ends; a housing accommodating said motor with said motor shaft; a spur gear arranged on one end of said eccentric shaft which is remote from said sanding disk and rolling off on a fixable mating wheel which is arranged on said housing and formed as an annular gear; and at least one balancing mass serving as a fan and fixed on said hollow shaft on an end which is remote from said spur gear.

9. An eccentric disk sander, comprising a sanding disk; a spindle; a motor with a motor shaft; an eccentric via which said motor shaft moves said sanding disk with said eccentric taking with it said sanding disk gyrating with an eccentricity about a rotational axis and simultaneously rotating about said spindle which is eccentric with said eccentricity in relation to said rotational axis, said eccentric being formed as a hollow shaft which is open at its both ends and having an eccentric hole; and an eccentric shaft which carries said sanding disk and protruding beyond said eccentric hole at least at one of said ends; a housing accommodating said motor with said motor shaft; a spur gear arranged on one end of said eccentric shaft which is remote from said sanding disk and rolling off on a fixable mating wheel which is arranged on said housing and formed as an annular gear; and arresting means formed so that said annular gear can be hindered in its rotational movement by said arresting means, said housing having oblique slots, said adjusting means including bolts which are fixed to said annular gear and guided in said oblique slots of said housing.

10. An eccentric disk sander as defined in claim 9, wherein at least one of said bolts carries at least one clamping device which is tightenable so as to allow said adjusting means to be fixed.

11. An eccentric disk sander as defined in claim 9, wherein at least one of said bolts carries at least one detent which is tightenable so as to allow said adjusting means to be fixed.

* * * * *